US008905246B2

(12) United States Patent
Lynch

(10) Patent No.: US 8,905,246 B2
(45) Date of Patent: Dec. 9, 2014

(54) ARTICLE DISPENSING APPARATUS

(71) Applicant: Brian A. Lynch, Roswell, GA (US)

(72) Inventor: Brian A. Lynch, Roswell, GA (US)

( * ) Notice: Subject to any disclaimer, the term of this patent is extended or adjusted under 35 U.S.C. 154(b) by 0 days.

(21) Appl. No.: 13/815,195

(22) Filed: Feb. 9, 2013

(65) Prior Publication Data

US 2014/0224752 A1 Aug. 14, 2014

(51) Int. Cl.
*A47F 1/12* (2006.01)
*A47B 73/00* (2006.01)

(52) U.S. Cl.
CPC ..... *A47F 1/126* (2013.01)
USPC ..... 211/59.3; 211/74

(58) Field of Classification Search
USPC ..... 211/59.2, 59.3, 74, 75, 175, 184; 312/35, 42, 45, 61, 71; 108/60, 61
See application file for complete search history.

(56) References Cited

U.S. PATENT DOCUMENTS 2,129,122 A * 9/1938 Follett ..... 211/59.3
2,218,444 A 10/1940 Vineyard
2,289,751 A 7/1942 Brenholt
2,919,814 A * 1/1960 Berkowitz ..... 211/74
4,022,363 A * 5/1977 Eliassen ..... 294/87.2
4,318,485 A * 3/1982 Clement ..... 211/59.2
4,401,221 A * 8/1983 Suttles ..... 211/59.2
4,423,816 A * 1/1984 Suttles ..... 211/183
4,562,927 A * 1/1986 Fredrickson ..... 211/59.2
4,685,574 A * 8/1987 Young et al. ..... 211/59.2
4,706,821 A * 11/1987 Kohls et al. ..... 211/59.3
4,782,959 A * 11/1988 Kral et al. ..... 211/59.2
5,586,665 A * 12/1996 Brousseau ..... 211/59.2
5,586,687 A * 12/1996 Spamer et al. ..... 221/298
5,665,304 A * 9/1997 Heinen et al. ..... 312/71
5,695,074 A * 12/1997 Wiese ..... 211/59.2
5,695,075 A * 12/1997 Flum et al. ..... 211/59.2
5,706,956 A * 1/1998 Headrick et al. ..... 211/59.2
5,706,957 A * 1/1998 Hardy ..... 211/59.2
5,718,341 A 2/1998 Robertson
5,779,068 A * 7/1998 Whiten et al. ..... 211/117
5,947,303 A * 9/1999 Robolin ..... 211/59.2
5,957,327 A * 9/1999 Whiten ..... 221/289
6,073,785 A * 6/2000 Tolfsen ..... 211/183
6,189,734 B1 * 2/2001 Apps et al. ..... 221/193
6,478,167 B1 * 11/2002 Burgess ..... 211/59.2
6,523,719 B2 * 2/2003 Trulaske, Sr. ..... 221/301
6,766,911 B2 * 7/2004 Higgins ..... 211/59.2
8,453,850 B2 * 6/2013 Hardy ..... 211/59.3
2010/0032392 A1 * 2/2010 Camello et al. ..... 211/59.3

* cited by examiner

*Primary Examiner* — Joshua Rodden

(57) ABSTRACT

An article dispensing assembly is provided for supporting a plurality of product containers on a stacked array of shelves mountable on uprights in a compartment such as a refrigerated space. A first series of product containers of a first quality or character are supported in side-by-side substantially parallel rows on each shelf and a second series of product dispensers are supported respectively between adjacent rows of the first series of product containers. The shelves, in turn, are adjustably supported for fore and aft positioning on the uprights. The first series of products are indexed to the front of each shelf whereas the second series of products automatically are urged forwardly in their respective trays by a corresponding pusher assembly.

12 Claims, 15 Drawing Sheets

ARTICLE DISPENSING APPARATUS

BACKGROUND OF THE INVENTION

1. Field of the Invention

The present invention relates generally to article dispensing devices, and more particularly, to a new and improved article dispensing device or apparatus for storing, displaying and dispensing a multiplicity of articles from and within a defined space.

2. Description of the Prior Art

Generally, merchandizing devices in the form of shelving racks for storing, displaying, and dispensing various articles at the "point of sale" are well known in the art. For example, convenience stores or supermarkets conventionally use refrigerated cabinets including racks of shelving for storing, displaying and dispensing various beverage, food or other perishable product containers.

Typical examples of the foregoing prior art devices may be found in the following U.S. Pat. Nos. 2,218,444; 2,289,751; 5,706,956; 5,718,341; and 6,189,734.

U.S. Pat. No. 2,218,444 shows a simple "merchandising" rack disposed in a refrigerated compartment. The rack is inclined from back to front for serially dispensing via gravity a row of milk bottles or the like, the first one of which is held in position at the front or bottom of the rack by an arcuate-shaped bar or guard. When a customer removes the first bottle, the row of remaining bottles slides down the rack until the next bottle abuts and is held in place by the arcuate guard.

U.S. Pat. No. 2,289,751 illustrates a display rack containing multiple shelves superimposed one over the other in a "hi-rise" configuration where each shelf comprises multiple, spaced, parallel inclined racks for serially gravity-feeding containers from back to front. Here again, each rack terminates at its lowest elevation at the front or bottom of the rack in an arcuate bar or guard to maintain the first container in the row in an accessible position.

U.S. Pat. No. 5,706,956 discloses a merchandizing rack especially suited for stabilizing "tall" product containers moving along a path defined by a corresponding inclined track on a shelf in the rack. The stabilizing members are in the form of spaced parallel guide members supported on the underside of the shelf positioned immediately above each inclined track. The guide members in turn define guide channels for receiving and guiding the upper portion of each product container, the bottom portion of which is supported for movement by the corresponding below positioned inclined rack.

U.S. Pat. No. 5,718,341 shows a merchandising rack for tall product containers having guide channels for the upper portions of the containers, and further including a bridging member between adjacent guide channels to provide a "billboard surface" between the rows of supported containers.

U.S. Pat. No. 6,189,734 discloses a merchandising rack for rows of tall product containers supported at their upper portions by guide channels where the lead container in each row is dispensed into a corresponding support basket suspended at the front end of the inclined track defined by each guide channel.

Thus, while the above-described body of prior art indicates it to be well known to use merchandising assemblies in the form of shelving defining stacked rows of inclined product container support channels, a need exists to render such merchandising devices, as well as other known merchandising supports (e.g. flat shelf or spring-indexed arrangements) more efficient by maximizing the amount and type of product that may be stored, displayed and dispensed thereby.

More specifically, it would be extremely desirable to utilize the heretofore wasted space between the narrowed upper portions of tall product containers in prior art merchandising racks to store, display and dispense "auxiliary" products of a different quality or character. As an example, and without limitation, where the tall product is a 20 ounce bottle of soda pop, such an auxiliary product may comprise rows of candy bars or packages of chewing gum.

As will be made apparent from the following description hereinbelow, the foregoing desiderata is met by the present invention which broadly stated provides a new and improved merchandising or article dispensing apparatus uniquely featuring multiple-shelf stacking of a first product in parallel, adjacent rows on each shelf, in combination with auxiliary product dispensing assemblies positioned respectively between pairs of adjacent rows of the first product on each shelf, where the auxiliary products are of different kind or quality with respect to the first product. Additional advantages of the present invention over the prior art also will be rendered evident.

SUMMARY OF THE INVENTION

To achieve the foregoing and other advantages, the present invention, briefly described, provides an article dispensing or merchandizing assembly for supporting a plurality of product containers in adjacent rows on a stacked array of shelves mountable on uprights in a compartment such as a refrigerated space. A first series of product containers is supported in side-by-side substantially parallel array on each shelf and a second series of product containers is supported in dispenser trays positioned between adjacent rows of the first series of products. The shelves, in turn, are supported on the uprights by lugs adapted to engage notched slots in the guide channels to facilitate selective fore and aft adjustment of each shelf on the uprights. The first series of products can be fed by gravity along guide rails or channels to the front of each shelf where a "merchandising panel" or stop element is located to position the first product in each row for convenient access by a consumer. The second series of products automatically are urged forwardly in their respective dispenser trays by a corresponding spring assembly such that a second product may be dispensed at a point-of-sale proximal to the merchandising panel at the front of each row of the first product.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

It is therefore an object of the present invention to provide a new and improved merchandizing or article dispensing apparatus having all of the advantages of the prior art and none of the disadvantages.

It is another object of the present invention to provide a new and improved merchandizing or article dispensing apparatus for supporting a plurality of product containers in adjacent rows on a stacked array of shelves mountable on uprights in a compartment such as, for example, a refrigerated space.

Still another object of the present invention is to provide a new and improved merchandizing or article dispensing apparatus having a first series of product containers supported in a side-by-side substantially parallel array and a second series of product containers supported in dispenser trays positioned between adjacent rows of the parallel array, respectively, wherein the first series of products and the dispenser trays are supported on a corresponding shelf in a stacked array of shelves.

Yet another object of the present invention is to provide a new and improved merchandizing or article dispensing apparatus having a first series of products fed by gravity along a series of guide channels on a shelf, wherein the guide channels each have a corresponding stop member located at the front of the shelf, and wherein the merchandise assembly further has a second series of products stored in trays located between adjacent guide channels, respectively, wherein each tray has a resilient assembly for urging the products in a corresponding tray forwardly on each shelf to a dispensing location proximal to the stop elements of the guide channels between which that tray is disposed.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved article dispensing apparatus embodying the principles and concepts of the present invention will be described.

Figure 1:
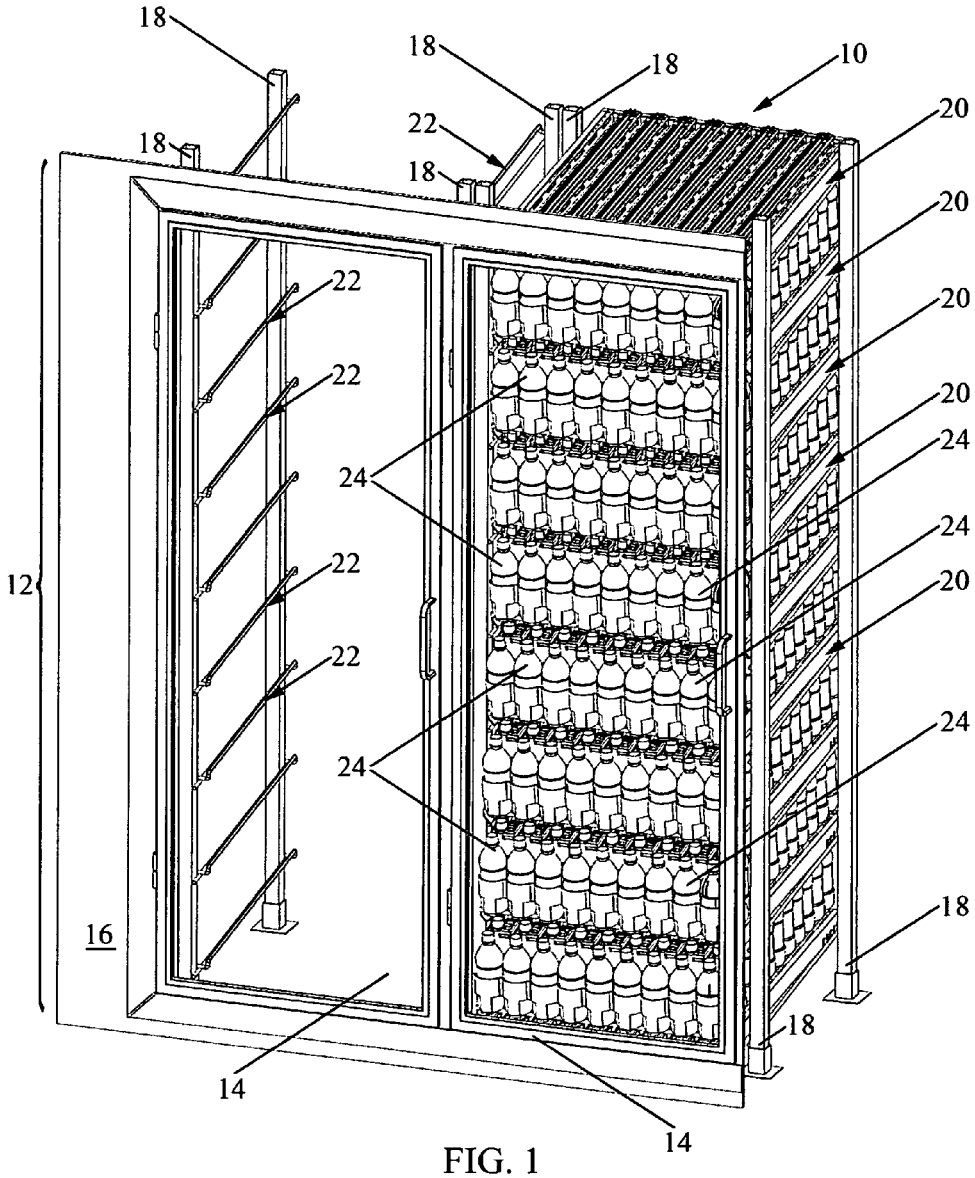
FIG. 1 is a front perspective view of a preferred embodiment of the invention showing a portion of a refrigerated compartment having the article dispenser apparatus of the present invention in one section thereof.

Turning initially to FIG. 1, a preferred embodiment of the invention is schematically depicted comprising a stacked article dispensing shelf assembly generally designated by reference numeral 10. As shown, the shelf assembly 10 typically is located within a generally box-like enclosure or compartment 12 having multiple juxtaposed transparent doors 14 suitably hingedly mounted with respect to the front wall 16 of the enclosure. Enclosure 12 typically may be a conventional commercial refrigerator such as employed in convenience stores or supermarkets for storing and dispensing various containers containing perishable goods such as soda pop, for example. It will be understood that the details of such refrigerators are well known and beyond the scope of the present invention. Thus, for purposes of ease of presentation, only a portion of the front wall 16 of such an enclosure is shown having a pair of juxtaposed doors 14. It will be understood that that the lateral extent of such refrigerators, and therefore the number of juxtaposed doors 14 provided in front wall 16, may be varied as needed to fit any available floor space.

Located within the interior space defined by compartment 12, substantially as schematically depicted, is a series of spaced uprights or vertical standards 18, each of which, in turn, has a series of evenly spaced openings on the rear face thereof extending from top to bottom (not shown in FIG. 1). Uprights or "standards" 18 also are of well known construction and form no part of the present invention.

In accordance with the present invention, stacked assembly 10 includes a plurality of superimposed individual dispenser shelves generally designated by reference sign 20, each of which is of unique construction as will be explained in further detail below. Shelves 20 are adapted to be supported in a downwardly inclined orientation from back-to-front between spaced pairs of uprights 18 by means of similarly inclined wire supports generally indicated by reference sign 22, each of which has its opposed ends inter-engaged with corresponding openings in uprights 18 (e.g. see left side of FIG. 1). By inclining the shelves 20 from back-to-front, it will be appreciated that articles supported from each shelf, such as for example, beverage containers 24, may be fed or indexed via gravity to the front of each shelf 20 proximal to the inside surface of each door 14 for convenient point-of-sale pick-up by a consumer.

While this is the mostly preferred mode of carrying out the present invention, shelves 20 may optionally be mounted in a "flat" or horizontal condition, and further, suitable means may be employed in lieu of gravity to index the beverage containers 24, or other articles, along the top surface defined by the horizontally-disposed shelves 20, such as for example, a suitable spring mechanism mounted at the rear of each shelf. Alternatively, the articles on the shelves 20 so horizontally disposed manually may be indexed thereon, if so desired.

Figure 2:
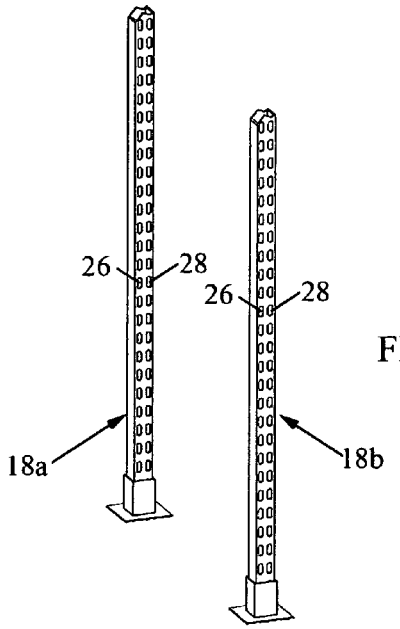
FIG. 2 is a perspective elevational view showing the openings in the rear surface of the vertical standards employed in the refrigerated compartment of FIG. 1.
Figure 3:
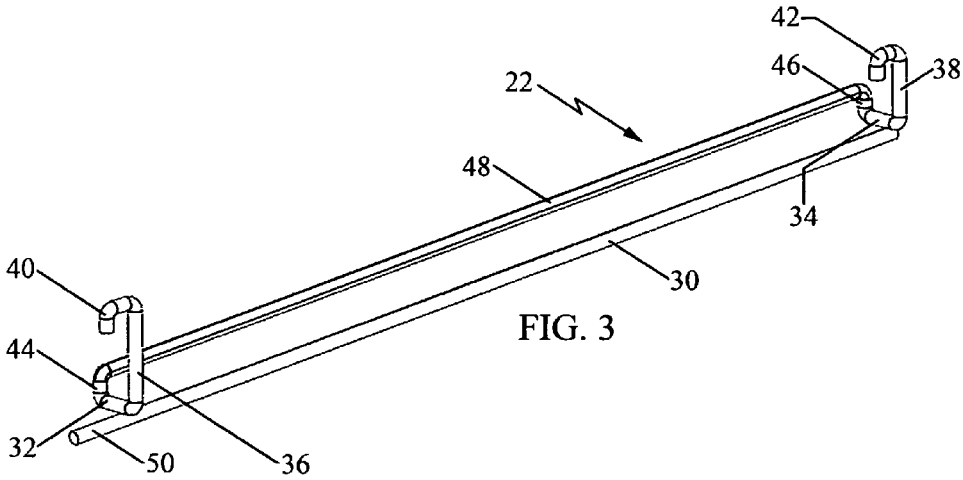
FIG. 3 is a perspective view of a wire bar assembly employed with the present invention.
Figure 4:
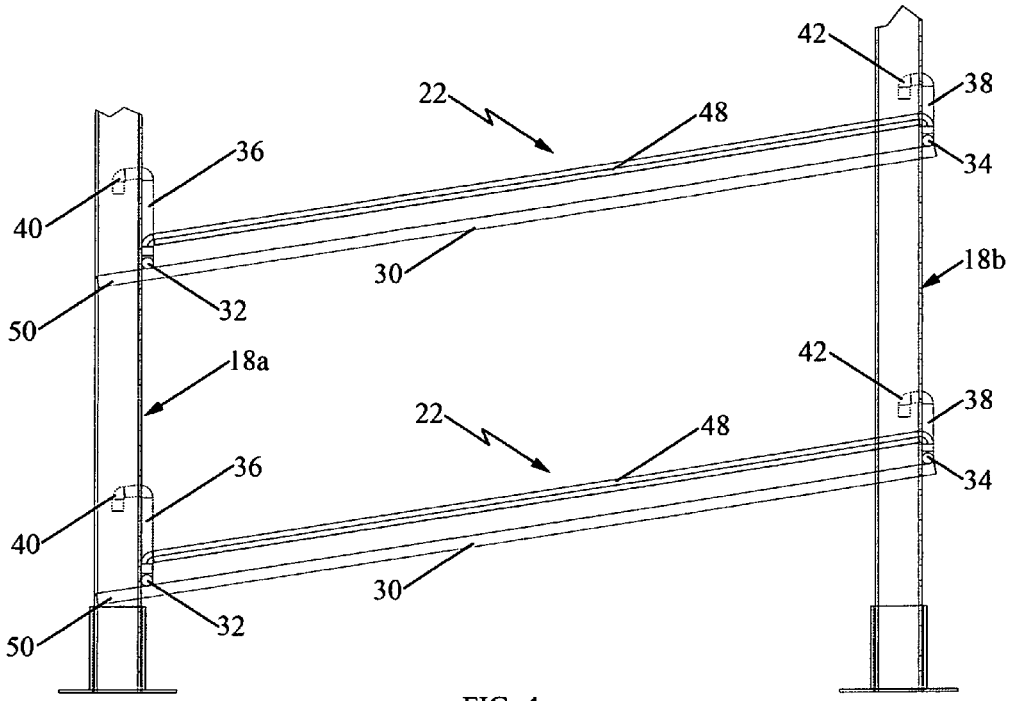
FIG. 4 is an elevational side view showing a pair of wire bar assemblies mounted on a pair of vertical standards.
Figure 6:
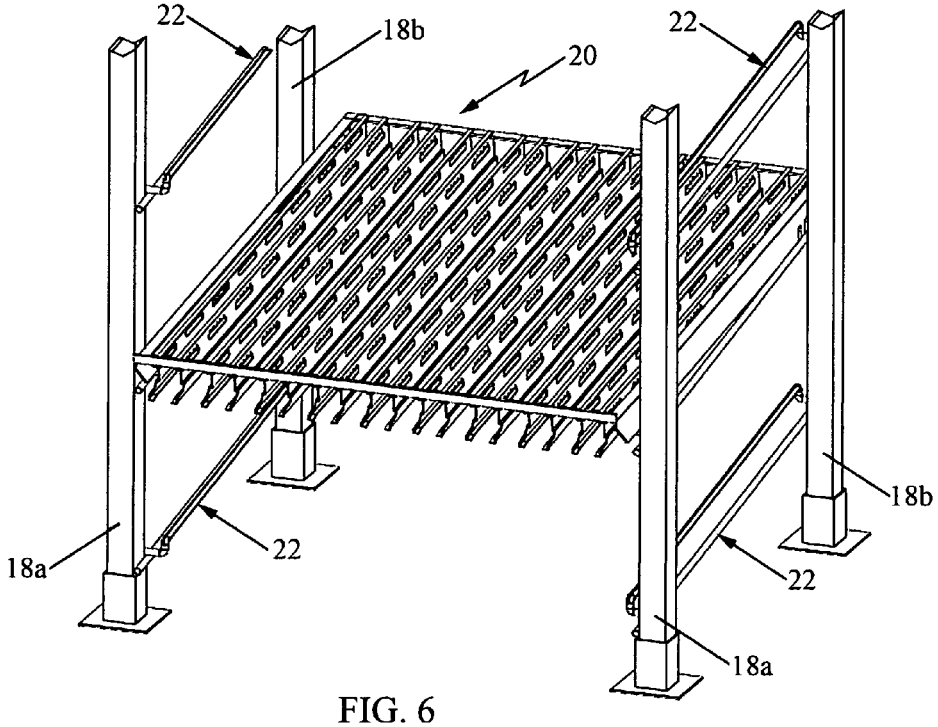
FIG. 6 is a perspective view of one dispenser shelf of the invention supported via wire bar assemblies on spaced pairs of vertical standards.

Turning to FIGS. 2-4, the openings on the rear face of uprights 18 actually comprise evenly spaced pairs of juxtaposed openings 26, 28 substantially as depicted (FIG. 2). In FIGS. 2, 4, and 6, the frontward standard is given the reference sign 18*a* whereas the rearward standard is given the reference sign 18*b* with the words "frontward" and "rearward" being used with reference to the front hinged door of enclosure 12 (FIG. 1).

FIG. 3 shows each wire bar assembly 22 comprising a first longitudinally extending straight portion 30, rigidly attached to transverse portions 32 and 34 substantially as depicted. The transverse portions each terminate at one end thereof respectively in upstanding portions 36, 38 which in turn terminate in corresponding hook portions 40, 42 facing leftward substantially as depicted in FIG. 2. The other opposed ends of transverse portions 32, 34 are joined respectively to corresponding riser portions 44, 46 which in turn are integrally joined to the opposed ends respectively of a second longitudinally extending straight portion 48 in such manner as to dispose the second straight portion 48 of wire bar assembly 22 above and generally parallel to the first straight portion 30, as also substantially shown in FIG. 2.

By virtue of the foregoing construction, each wire bar assembly 22 is adapted to be securely supported between a pair of front-to-back vertical standards 18*a*, 18*b* in a forward downwardly inclined orientation. More specifically, and substantially as shown in FIG. 4, the hook portion 42 of a wire bar 22 may be engaged with a corresponding opening 26 in the rearward-positioned standard 18*b* whereas the hook portion 40 of the same wire bar may be engaged with a corresponding opening 26 in the forward-positioned standard 18*a*, with the engaged opening in the forward standard being at a lower elevation than the engaged opening in the rearward standard. When this is done, the wire bar assembly 22 is disposed at a suitably selected front downwardly inclined angle substantially as shown in FIG. 4.

FIG. 4 shows two wire bar assemblies 22 mounted one above the other on standards 18*a* and 18*b*. It will be appreciated that the vertical separation or "height" distance between the superimposed wire bar assemblies 22 of FIG. 4 adjustably may be selected merely by engaging the opposed hook portions in appropriate openings 26 or 28 on standards 18*a*, 18*b*. This adjustment capability permits articles of different size (e.g. height) to be efficiently stored on shelves supported by the wire bar assemblies as will be made more evident below. Finally, it will be noted in connection with each wire bar assembly 22 that the lower portion 30 includes a front end portion 50 that extends longitudinally beyond transverse portion 32 (FIG. 3). This front end portion 50 provides an abutment bearing against the side wall of a corresponding front standard 18*a* (FIG. 4) when the wire bar hooks 36, 38 are engaged in corresponding openings 26 or 28 on vertical standards 18*a* and 18*b* thereby facilitating stabilization of the wire bar assembly when it is so mounted.

In accordance with the present invention, a plurality or stack of uniquely constructed superimposed dispenser shelves 20 are supported via the aforedescribed wire bar assemblies 22 on conventional vertical standards located in the interior space of an enclosure, such as for example, a cooler or refrigerated compartment. Turning now to FIGS. 5-10, each dispenser shelf 20 comprises a box-like, four-sided generally rectangular-shaped member having a front edge panel 52, a left-side edge panel 54, a right-side edge panel 56 and a rear edge panel 58. The panels preferably are fabricated of steel for durability and strength and preferably each has a right-angle cross sectional shape.

Suitably rigidly attached to the front edge panel 52 and rear edge panel 58 and extending longitudinally therebetween are a series of generally parallel spaced, essentially identical guide rail members 60. The guide rail members 60 are disposed in separate pairs extending transversely between the left-side panel 54 and the right-side panel 56 with the spacing or width dimension between guide rails making up each pair being different than the spacing between each pair. Thus as shown in FIG. 7, in the preferred embodiment, spacing or width "X" is less than spacing or width "Y." In the preferred dispenser shelf 20 depicted in FIG. 7, there are provided nine (9) separate pairs of guide rails 60; however, this number merely is exemplary as will occur to those of ordinary skill.

Figure 7:
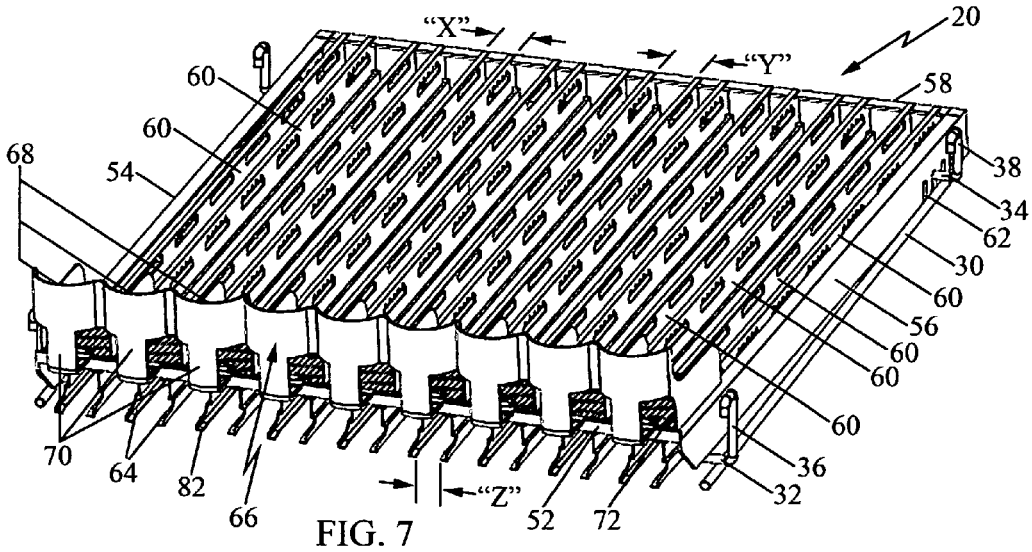
FIG. 7 is a perspective view of one dispenser shelf of the invention in engagement with a pair of wire bar assemblies and including a merchandising panel mounted on the front edge panel of the tray.

In accordance with the present invention, and as best seen in FIG. 7, the actual transverse spacing dimension "X" between individual guide rail members 60 making up each separate pair is selected suitably to support therebetween the neck portion of an article such as a soda pop beverage container 24 whereas the actual spacing dimension "Y" between individual pairs is selected to provide space for an auxiliary product dispenser assembly supported between juxtaposed separate pairs of guide rail members, as will be made more evident below.

Figure 5:
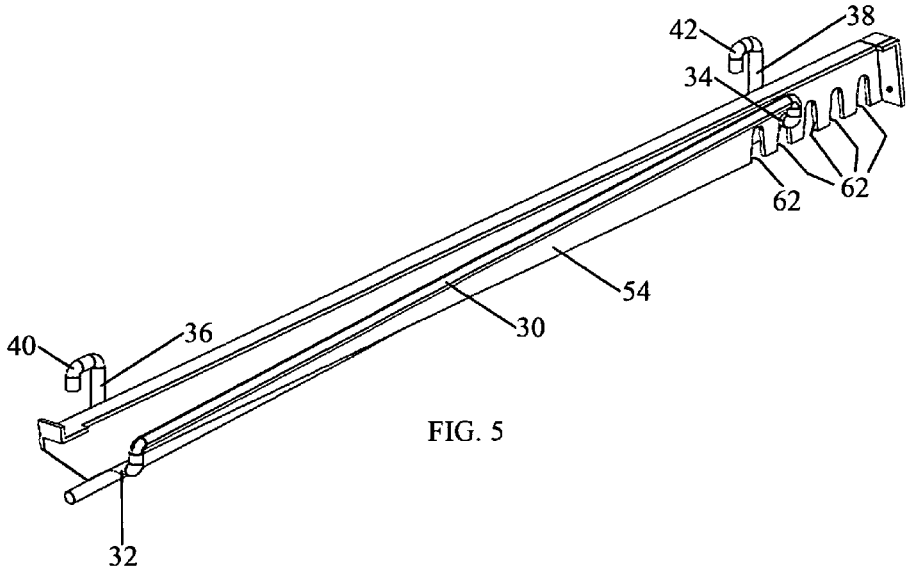
FIG. 5 is perspective view partially in cross-section showing the engagement between the side edge panel portion of the dispenser shelf of the invention in engagement a corresponding wire bar assembly.

As mentioned above, and as depicted in FIG. 6, each dispenser shelf 20 securely is supported on opposed pairs of wire bar assemblies 22 such that the front edge panel 52 of the dispenser shelf 20 is inclined downwardly. To facilitate such support, the left-side edge panel 54 and the right-side edge panel 56 each is provided with a series of slotted openings or notches 62 intercepting the bottom surface thereof proximal to rear edge panel 58 (FIGS. 5 and 7). Slotted openings 62 are sized sufficiently to securely receive therein the transverse portions 32 and 34 of each wire bar assembly 22. Thus, as shown, for example, in FIG. 5 with respect to the left-side edge panel 54 of dispenser shelf 20, when the transverse portion 34 of the corresponding wire bar assembly is engaged in a corresponding notch 62, the left-side edge panel's bottom surface (proximal to front edge panel 52) engages and bears against transverse portion 32 of wire bar assembly 22. The same engagement arrangement occurs with respect to the right-side edge panel 56 and its corresponding wire bar assembly 22 (FIGS. 7 and 8).

In accordance with the invention, because there is a series of axially spaced notches 62 provided in both opposed side-edge panels of each dispenser shelf 20, it is possible easily to axially adjust the longitudinal position of each individual dispenser shelf 20 with respect to the wire bar assemblies, the standards, and the inside front surface of the compartment door by merely selecting the appropriate notches 62 (in the row of notches) to engage with the corresponding transverse portions on the corresponding supporting wire bar assemblies 22 when the tray dispenser shelf or shelves initially are assembled on the vertical standards inside the compartment.

Figure 9:
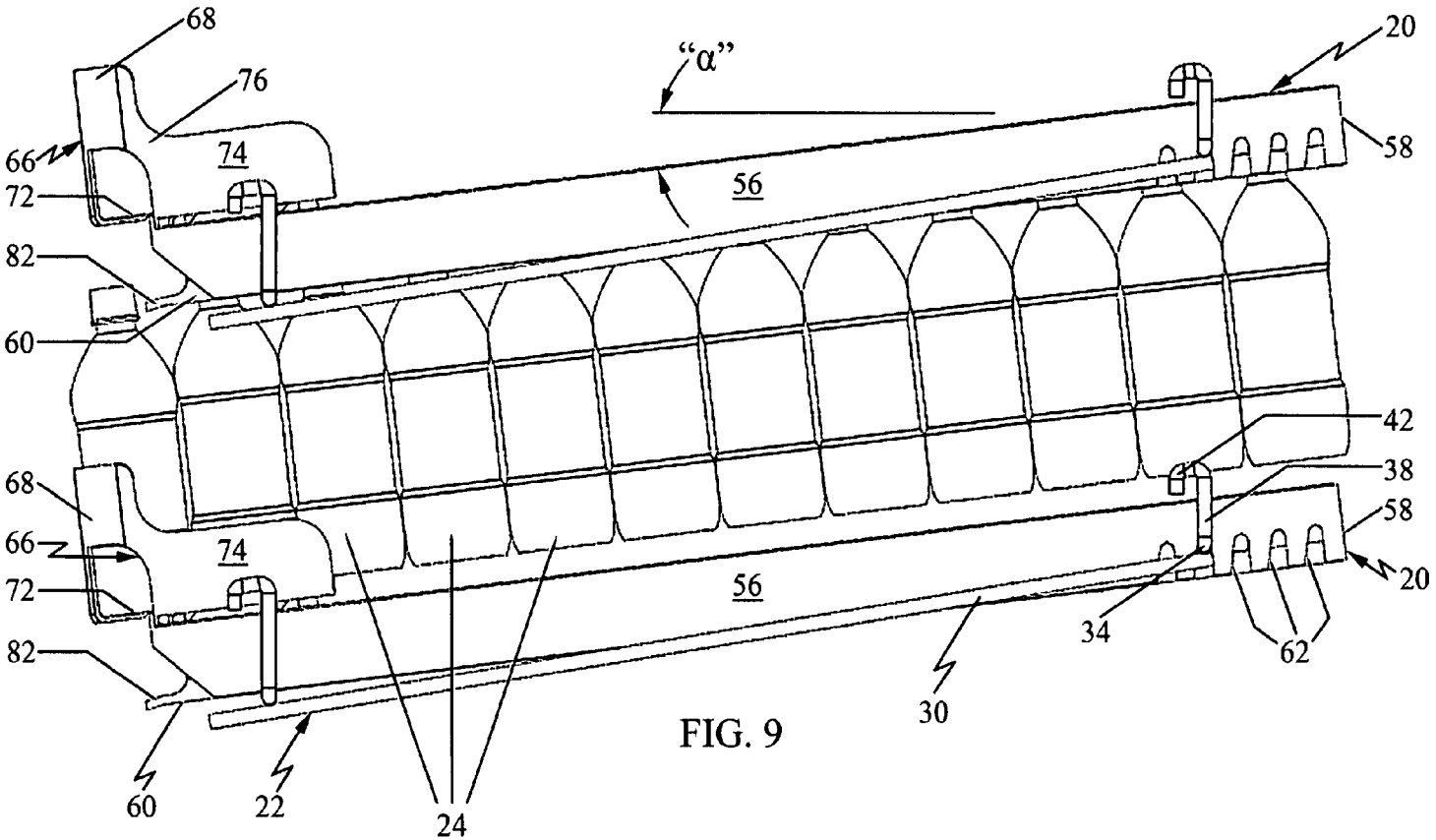
FIG. 9 is a side view of the dispenser shelves of FIG. 8.
Figure 10:
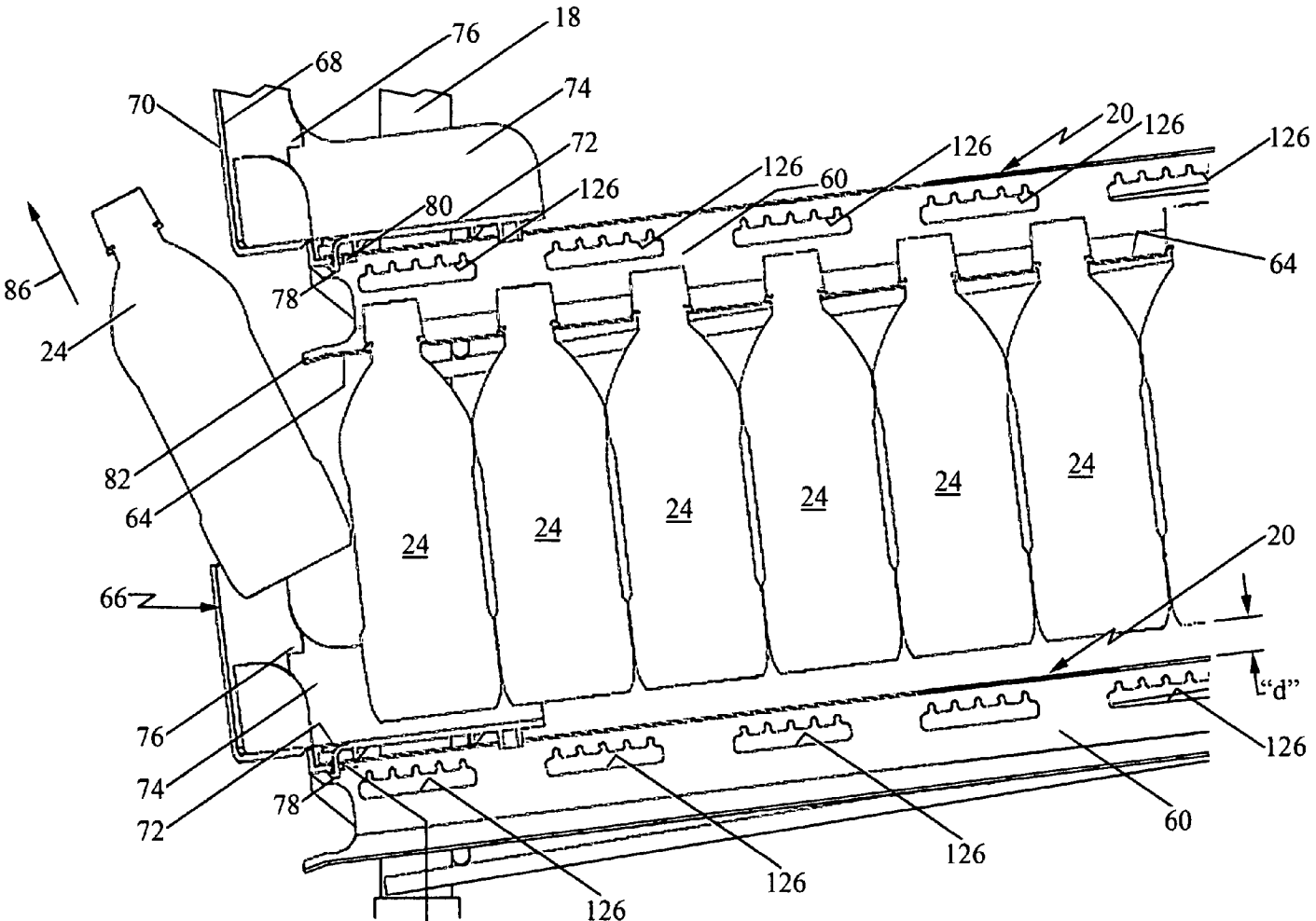
FIG. 10 is a cross-sectional view taken longitudinally through the center of the rightmost row of stored articles in FIG. 8.

As shown in FIG. 7, the bottom portions of the guide rails 60 making up each separate, individual pair of guide rails are substantially L-shaped in cross-section to define corresponding pairs of opposed, protruding, confronting transversely-spaced lips or edges 64 suitable to support a line-up or row of product containers 24 by engaging the product containers underneath a circumferential collar, support ring, or the like on the container proximal to the container's top closure cap (see also FIG. 10). In this regard, the width dimension between confronting guide rail bottom edges 64 is such as to provide slidable support for the containers along the longitudinal or axial extent of the guide rails and is indicated schematically by distance "Z" in FIG. 7. It will be noted in FIGS. 9 and 10 especially, that the bottom edge 64 of each guide rail 60 terminates in a downwardly inclined ramp portion 82 substantially as depicted.

Figure 8:
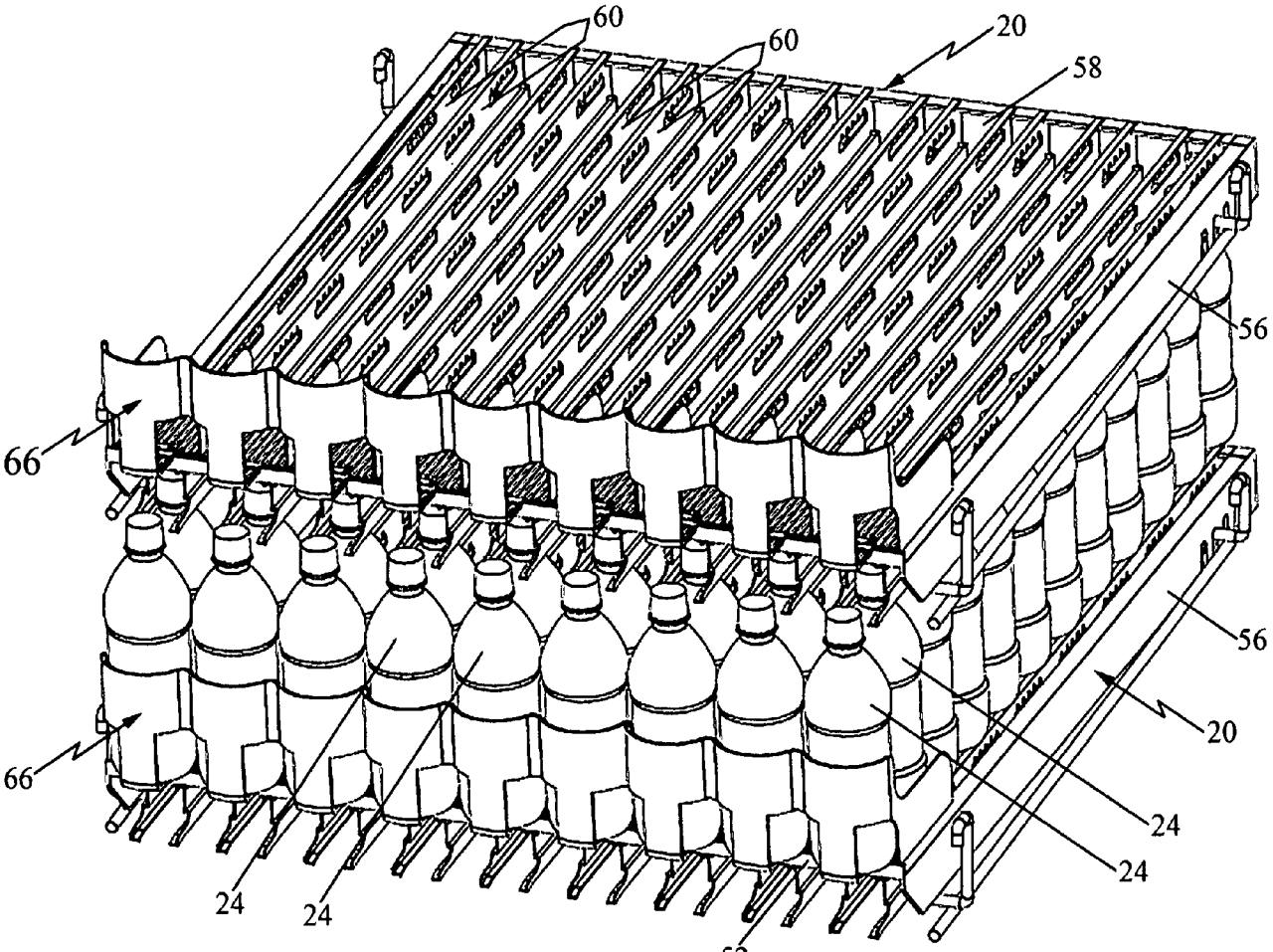
FIG. 8 is a perspective view of a pair of superimposed dispenser shelves according to the invention with the bottom shelf in the array having articles to be dispensed stored thereon.

Attached or otherwise affixed to the front edge panel 52 on each shelf 20 substantially as depicted in FIGS. 7-9 is an upstanding "merchandising panel" generally indicated by reference sign 66. The term "merchandising panel" is used herein because this structural part is located at the front of the dispenser shelf array and is immediately observable by a consumer. Further, the merchandising panel supports product containers that have been dispensed (via gravity) to a convenient location at the front of the dispenser shelf array immediately confronting the consumer following opening of the door of the enclosure housing the array, and thus defines the "point of sale." Finally, the "merchandising panel" presents a front surface which may contain advertising or other indicia thereon and which immediately is visible to a consumer, either through the transparent door or upon opening the door.

As depicted in FIGS. 7-10, merchandising panel 66 defines a series of side-by-side arcuate container receiving sections 68, each being associated with a separate pair of guide rails 60, respectively. The arcuate sections 68 respectively are supported in an upward position by an integral riser member 70 which in turn is supported by an orthogonal floor panel section 72 overlying front edge panel 52 and proximal portions of guide rails 60. Merchandising panel arm sections 74 extend upward from floor panel section 72 and are attached to either end of a corresponding arcuate section 68 by means of a pair of narrow web sections 76.

Preferably, the merchandising panel 66 is removably affixed on or to the front edge panel by snap-fitting fingers 78 adapted to suitably engage openings 80 in the top portion of panel 52. Preferably, the merchandising panel is fabricated from a molded plastic material and is of one-piece construction. Alternatively, merchandising panel 66 may be made up of multiple smaller identical sections, placed on the front edge panel 52 in a side-by side manner.

It is to be appreciated with reference to FIGS. 8-10 that in accordance with the present invention, the product containers 24 adapted to be stored seriatum on each individual pair of guide rails 60 are fed by gravity along the inclined rails to the front of the shelf 20 proximal to the inside surface of the enclosure (e.g. refrigerator) door whereupon they are held in place by the arresting effect of the merchandising panel which acts as a "stop," "guard" or "fence" for the product containers. It must also be understood that the product containers stored on a particular dispenser shelf 20 ultimately and normally are maintained at rest by the stop-action of the merchandising panel affixed to the front portion of the shelf located immediately below that particular shelf.

This novel arrangement clearly is demonstrated in FIGS. 8 and 9, which show an "upper" shelf 20 superimposed over a "lower" shelf 20. In accordance with the preferred embodiment, the two shelves acting together are shown to be supporting nine (9) rows of product containers 24, each row being twelve (2) containers deep. Importantly, the product containers 2-12 in each row are suspended from their corresponding guide rails on the "upper" shelf such that the bottoms of the product containers remain elevated above the surface of the "lower" shelf 20 i.e. the shelf located immediately below, by a distance "d" (FIG. 10). The front or first product container in each row however is supported in and by the corresponding section of the merchandising panel attached to the front edge panel on the "lower" shelf (or the shelf immediately below the upper shelf). Hence, as shown in FIGS. 8 and 9, the first container in the row normally is resting on the floor panel 72 of the merchandising panel affixed to the "lower shelf" whereas the remaining containers in each row are supported by the guide rails 60 on the "upper shelf."

Inasmuch as the merchandising panel section 68 associated with a particular row of product containers extends axially beyond front edge panel 52 a distance forwardly of the terminus of ramp portion 82 (FIGS. 9 and 10), when a consumer selects a product container 24 by lifting the article from the corresponding section 68 of the merchandising panel (indicated by arrow 86, FIG. 10), the remaining backed-up articles 24 in the row are caused to slide forward under the urge of gravity whereupon the next container in line slides off ramp portion 82 and comes to rest in the vacated section 68 of the merchandise panel where the removed container had previously been.

From the foregoing, it will be appreciated that broadly speaking, the present invention contemplates dispensing a row of articles along a pair of guide rails on a first shelf to a location where the articles in the row are fed by gravity seriatum to a "point-of-sale" defined by a stop member (e.g. merchandising panel 66) suitably affixed to essentially a second shelf positioned under the first shelf.

It will also be appreciated that the shelves 20 of the disclosed article dispenser apparatus 10 of the invention achieve the advantage of "maximum space" efficiency by enabling a large number of product containers to be stored and dispensed from a given shelf. To even further enhance the "maximum space" efficiency of the dispenser shelf 20, an auxiliary product dispenser assembly generally indicated by reference sign 90 may also be supported on each shelf as will now be described in connection with FIGS. 11-14.

Figure 11:
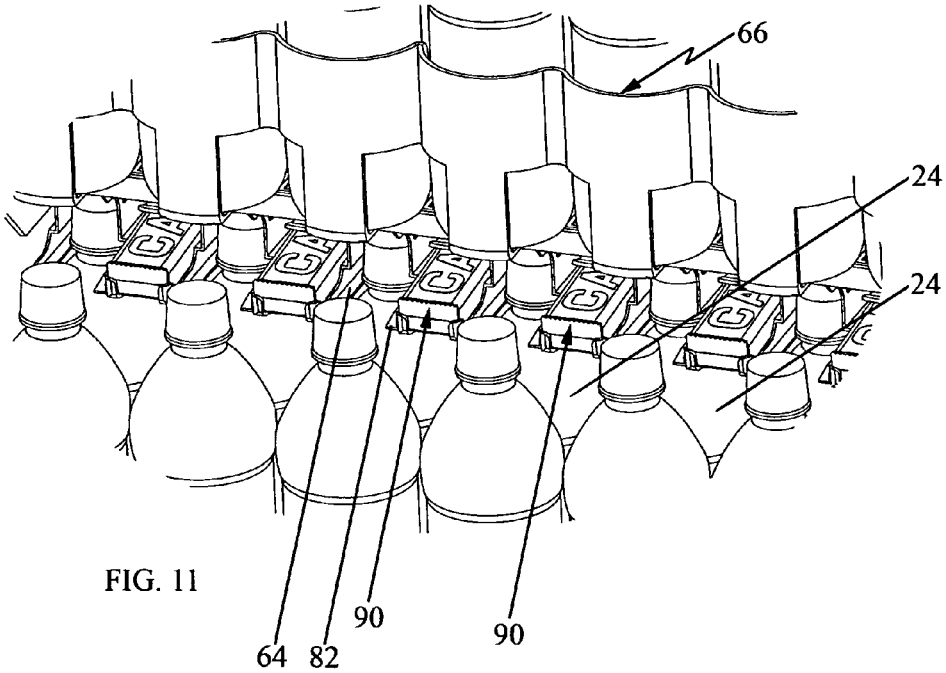
FIG. 11 is fragmentary enlarged view of a portion of the apparatus of FIG. 1 showing employment of auxiliary product dispenser units in accordance with the invention supported between juxtaposed pairs of product-supporting guide rail pairs.
Figure 12:
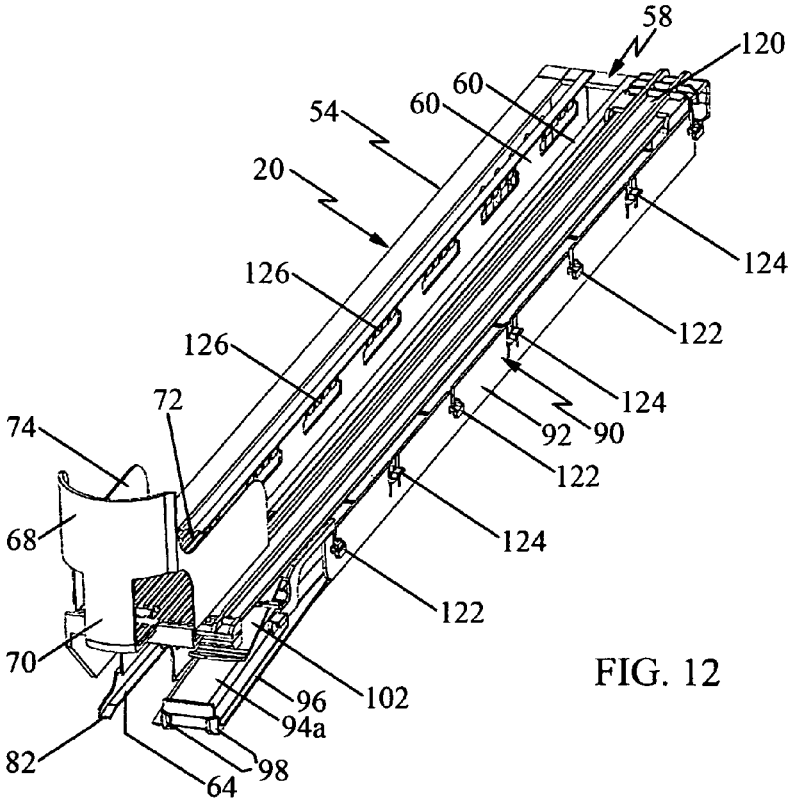
FIG. 12 is a perspective view of a portion of the invention comprising a product-supporting guide rail pair and a juxtaposed auxiliary product dispenser supported thereon.

As schematically indicated in FIG. 11, the preferred auxiliary product dispenser assembly 90 comprises a "candy bar" dispenser located between each row of product containers 24 proximal to the terminus of the guide rail ramp portions 82 associated with each pair of guide rails 60, respectively (see also FIG. 12). The candy bar dispenser 90 in turn comprises a longitudinally extending tray 92 having essentially a U-shaped cross-sectional shape for housing a series of rectangular-shaped candy bars 94 or the like in serial, abutting fashion substantially as depicted (FIG. 14). An integral, slightly downwardly inclined ramp portion 96 extends forwardly from tray 92 and terminates in a pair of laterally up-struck tabs 98 which serve as stop elements for the first or lead candy bar 94*a* in the longitudinal row of candy bars 94 (FIGS. 12-14).

Figure 13:
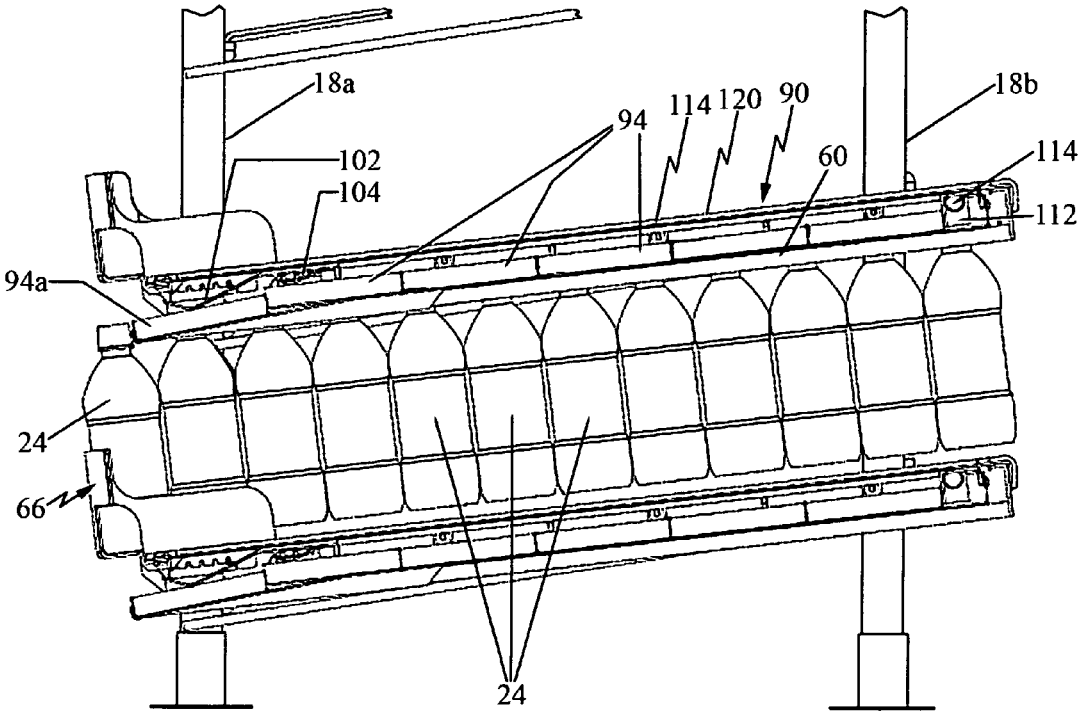
FIG. 13 is a vertical cross-sectional view through the auxiliary product dispenser according to the invention mounted proximal to the bottom of the article dispensing apparatus.
Figure 14:
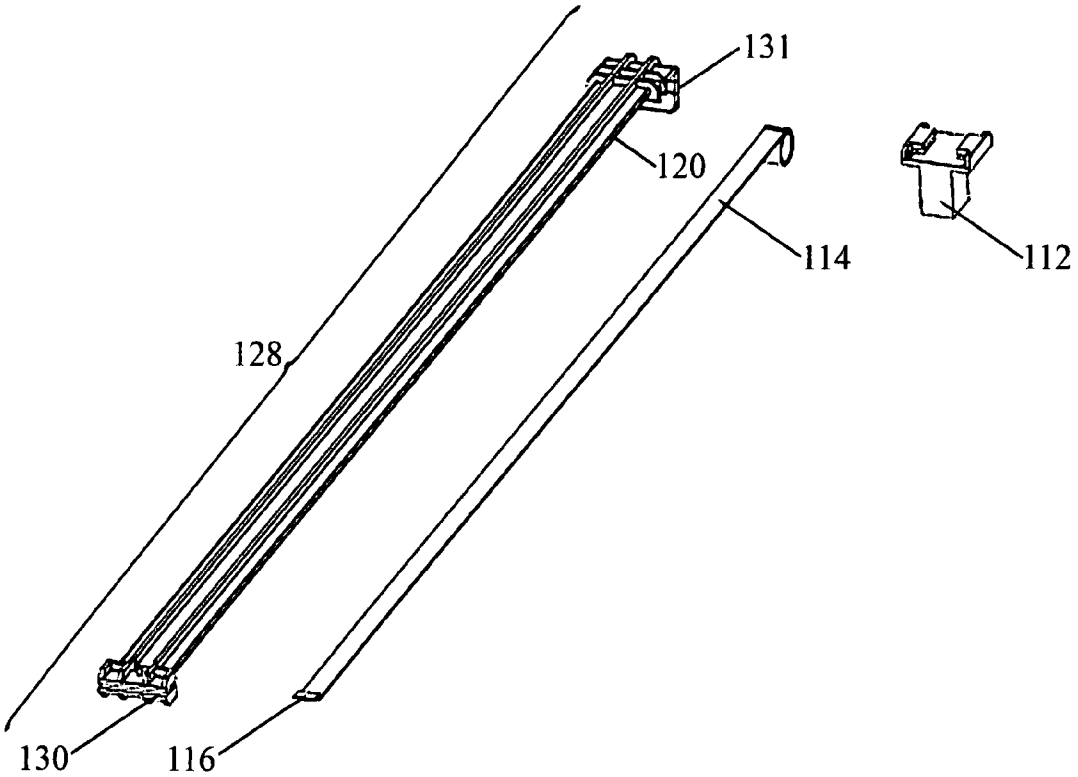
FIG. 14 is an exploded view in perspective of a first or top portion of the auxiliary product dispenser according to the invention.
Figure 15:
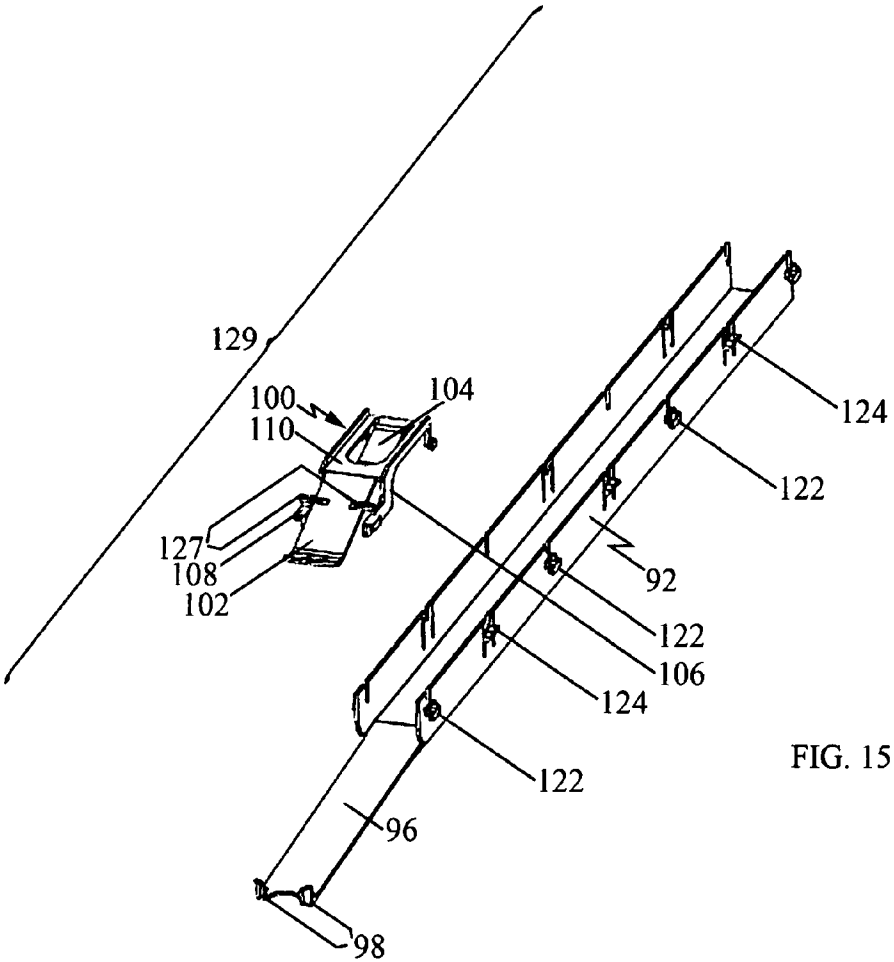
FIG. 15 is an exploded view in perspective of a second or bottom portion of the auxiliary product dispenser according to the invention.
Figure 16:
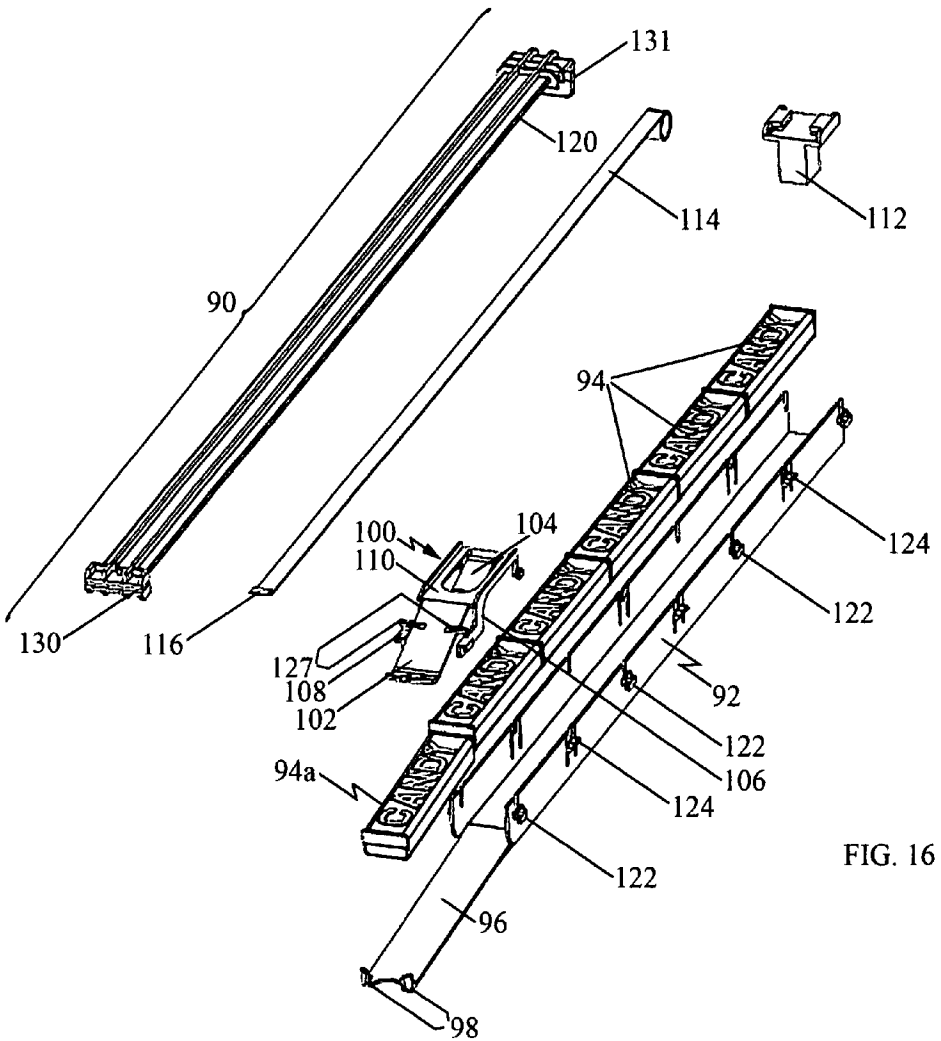
FIG. 16 is an exploded view in perspective of the auxiliary product dispenser according to the invention.

A spring assembly 100 having a first cantilever leaf-spring 102 and a second somewhat smaller cantilever leaf spring 104 positioned rearwardly thereof (see FIGS. 13 and 15) is adapted to be suitably retained on the front portion of tray 92 in overlying relation to ramp portion 96 via opposed arm portions 106, 108 such that first leaf spring 102 bears down against and resiliently engages the first candy bar 94*a* and the second leaf spring 104 bears down against and resiliently engages the next candy bar 94 located immediately behind (FIGS. 12 and 13). Spring assembly 100 also has a flat table portion 110 supported between arm portions 106, 108 and slightly recessed therebelow (FIGS. 15 and 16).

A rear-pusher-block member 112 is positioned at the rear of tray 92 behind the last or distally located candy bar 94 and is adapted to house interiorly thereof a spiral-spring assembly 114 of the type having memory which tends to urge the spring when tensioned axially, to want to return to its coil shape, as is well known in the spring art. Spiral spring assembly 114 terminates distally in an enlarged pin 116, the purpose of which is to engage a suitable reception slot therefore (not shown) located on the inside surface of elongated tray cover 120 proximal to the cover's leftmost end as viewed in FIGS. 13 and 14. As best indicated in FIGS. 12 and 13, cover 120 suitably snap-fits over the top of tray 92 and maintains rear-pusher-block member 112, spiral spring assembly 114, and spring clip assembly securely in place, substantially as depicted. That is, as best viewed in FIG. 13, spiral spring assembly 114 extends axially from the rear of pusher block 112, along the top of tray 92, to its anchoring position at the front end of cover 120 (leftmost side in FIGS. 2-14). In this arrangement, it will be noted that the spiral spring 114 extends over and is supported on table flat 110 of spring clip assembly 100.

In accordance with the invention, the preferred candy bar dispenser assemblies 90 are attached in position between adjacent (juxtaposed) pairs of guide rails 60 defining each row of products 24 being dispensed via shelf or shelves 20. Nonetheless, for the sake of simplicity of presentation, a single candy bar dispenser assembly 90 is shown attached to a single pair of guide rails in FIG. 12, and more precisely to one of the guide rails 60 in that pair. Such attachment is effected in accordance with the invention by means of flexible, protruding fingers or lugs 122, 124 provided on each opposed side surface of tray 92, and which are sized and configured suitably to inter-engage with oblong slots 126 provided in each guide rail member 60. The slots 126 are evenly spaced and extend longitudinally along substantially the full axial extent of each guide rail member (see FIG. 10).

As the result of the foregoing construction, each individual candy bar dispenser assembly 90 easily may be inserted between adjacent pairs of guide rails 60 by first pushing the tray sub-assembly 129 in a generally downward direction. This is done by first moving the sub-assembly downward and at an angle to rails 60 such that ramp portion 96 is lower in relative elevation with respect to rails 60 as is the opposing end of sub-assembly 129. Once ramp 96 is lower in elevation than 52 and sufficiently forward to bring protruding flexible lugs 122, 124 in vertical alignment with oblong slots 126, the angle of the sub-assembly 129 is reduced until it is approximately parallel to 60.

In doing so, protruding flexible lugs 122, 124 on the opposed side surfaces of the U-shaped tray 92 enter corresponding oblong slots 126 on the confronting guide rails 60 whereupon they will "snap-fit" into engagement. More specifically, lugs 122 will resiliently engage the smooth lower surface of a corresponding slot 126 whereas lugs 124 will resiliently engage the notched upper surface of each corresponding slot 126. Sub-assembly 128 is then added to the assembly in a similar manner. Sub-assembly 128 is moved in a generally downward manner with slot 130 lower in elevation relative to 60 than snap 131 on the opposing end.

Once slot 130 is slid over 52, the angle of sub-assembly 128 is reduced until it is approximately parallel to 60. In doing so, snap 131 will releasably engage rear edge panel 58. Because the oblong slots 126 have a series of axially-arrayed notches in their upper portions, lateral adjustment of each dispenser assembly 90 relative to each guide rail 60 is possible by first depressing 102 thereby lowering 127 relative to the axially-arrayed notches and merely shifting the dispenser 90 laterally front to back. Once in position, 102 is released, thereby returning 127 to an engagement with the axially-arrayed slots.

In use, selection of the first "candy bar" by a consumer causes the remaining candy bars in tray 92 automatically to advance forwardly under the influence of spiral spring assembly 114 which in turn causes pusher block member 112 to move the row of candy bars toward the front of dispenser assembly 90 until the second candy bar in line is stopped in its frontal display position on ramp portion 96 by the arresting action of upstanding lugs 98.

As mentioned hereinabove, the dispenser shelves 20 optionally may be mounted in a "flat" or horizontal condition, and further, suitable known means employed in lieu of gravity to index the beverage containers 24, or other articles, along the flat disposed trays. Thus, turning now to FIGS. 17-19, there is shown an alternatively preferred embodiment of the invention utilizing such a "flat" or horizontally-mounted shelf arrangement generally indicated by reference sign 200.

Figure 17:
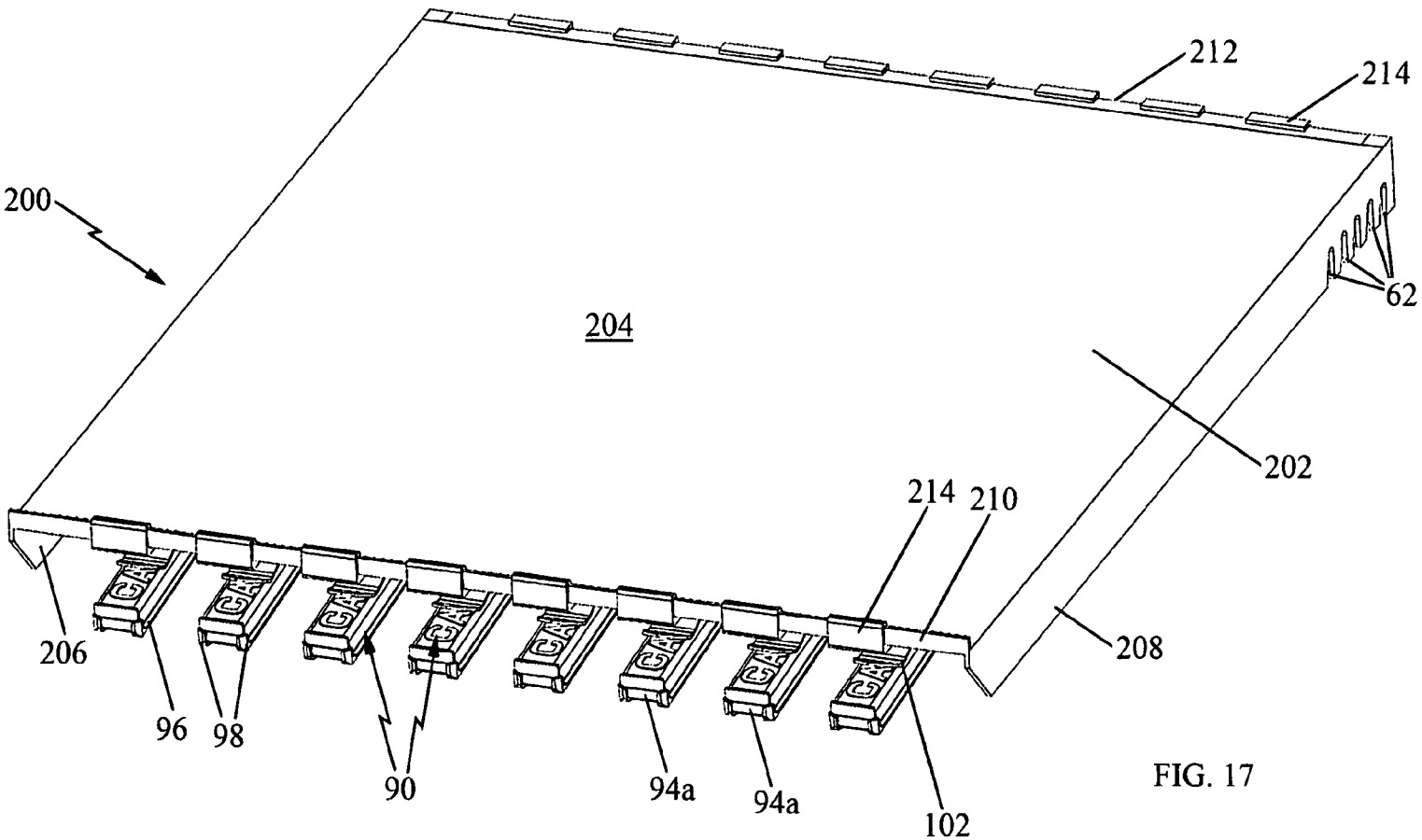
FIG. 17 is a perspective view of an alternatively preferred embodiment of the invention, showing a product support shelf adapted to be oriented horizontally and to have a plurality of auxiliary product dispensers supported on the underside thereof.
Figure 18:
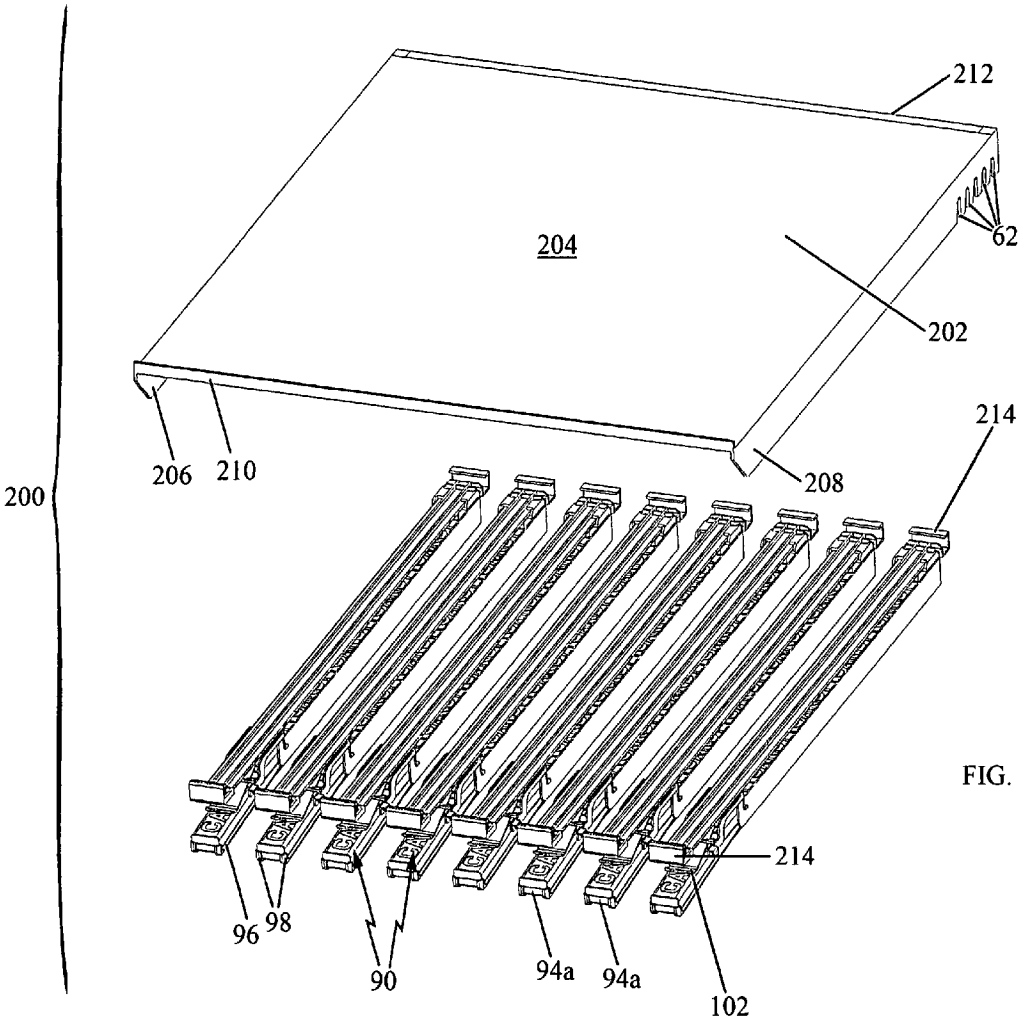
FIG. 18 is an exploded view in perspective of the alternatively preferred embodiment of FIG. 17.

Product dispensing shelf 200 preferably is generally of one-piece or unitary construction and features a substantially flat main panel 202 defining a substantially flat top surface 204, a pair of opposed side-edge panels 206, 208, a front edge 210, and a rear edge 212, substantially as depicted (FIGS. 17 and 18). Side edge panels 206, 208 are similar to side edge panels 54, 56 and include rearwardly thereon substantially as depicted an array of slotted openings or notches 62 substantially similar to the shelf of the prior embodiment (see FIGS. 5 and 6). By virtue of this arrangement, it will be appreciated that each alternatively preferred dispenser shelf 200 is capable of being supported in a substantially horizontal manner (adjustably so fore and aft) by use of the same wire supports 22 and vertical standards disclosed above (FIGS. 4-6), and in the same fashion, with the proviso that the wire supports 22 are to be mounted substantially horizontally on the standards 18*a*, 18*b* via appropriate selection of openings 26, 28, i.e. the openings in the front and rear standards should be at essentially the same relative elevation to assure horizontality of the wire supports 22 and therefore of the shelf 200 so mounted thereon.

Figure 19:
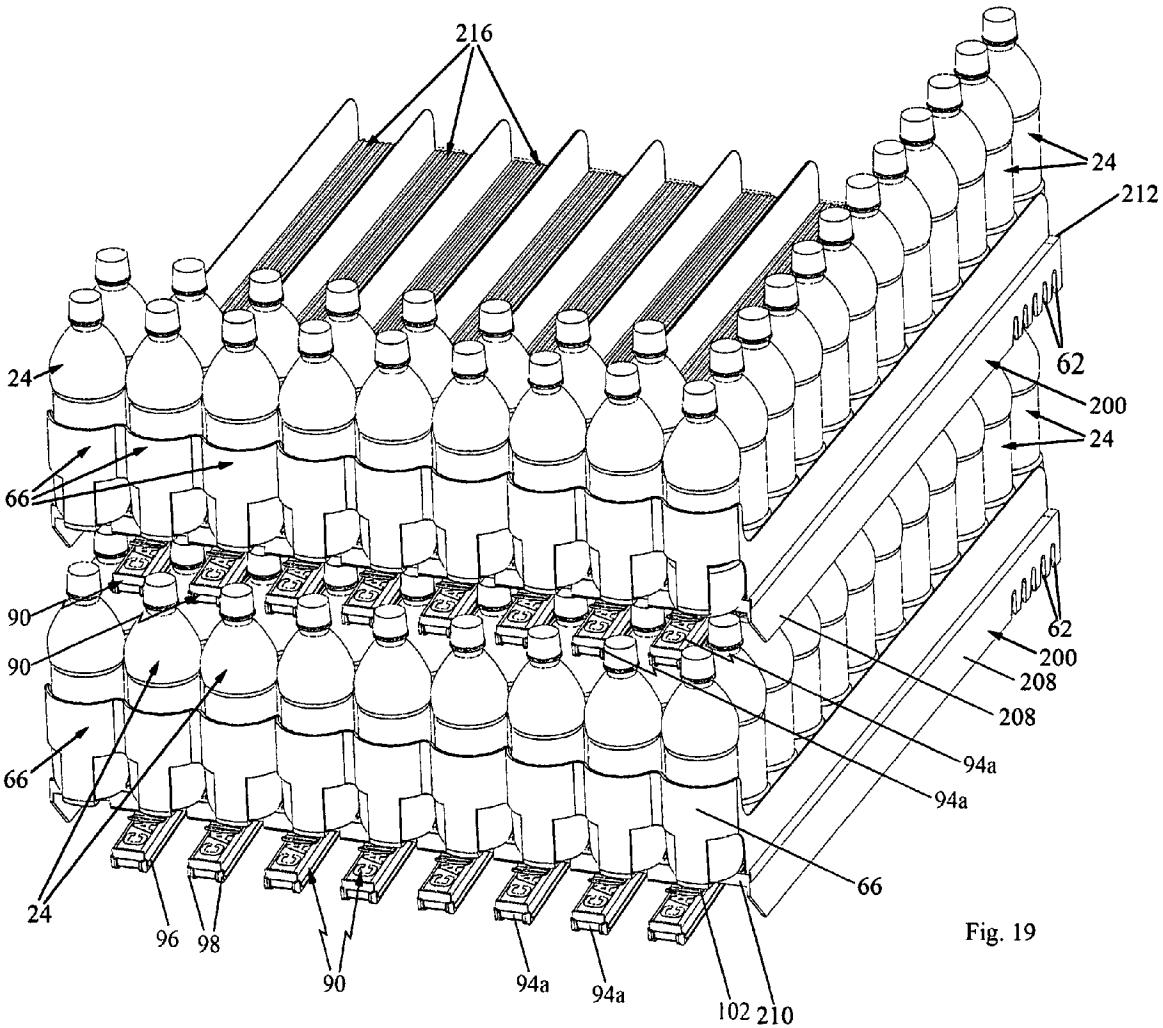
FIG. 19 is a perspective assembly view of the alternatively preferred embodiment of FIGS. 17 and 18 showing a pair of horizontally-disposed, superimposed shelves with rows of products (e.g. beverage containers) supported on the upper surface thereof, respectively, and a plurality of auxiliary product dispensers arranged in a spaced side-by-side manner proximal to the undersurface of each shelf, respectively, and wherein each auxiliary product dispenser is positioned between adjacent rows of such beverage containers.

In accordance with the alternatively preferred embodiment of FIGS. 17-19, and substantially as depicted, the auxiliary product dispenser assemblies 90 can be removably mounted proximal to the undersurface of each dispenser shelf 200 preferably in an evenly spaced array, and preferably, by the use of a pair of suitable resilient spring clips 214 engageable with and between opposite ends of the cover 120 of each dispenser assembly 90 on the one hand, and the front edge panel 210 and rear edge panel 212, respectively, of shelf 200 on the other hand (see FIGS. 17 and 18 for use of clips 214).

In use, product containers 24 conveniently can be disposed on the top flat surface 204 of horizontally-disposed shelf 200 in front-to-back dispensing rows using commercially available conventional plastic trays 216 each containing side walls, a textured bottom portion and a front mounted "merchandising panel" 66 defining the point of sale of the shelf. An exemplary arrangement, employing a pair of superimposed dispensing shelves 200 schematically is depicted in FIG. 19. Substantially as illustrated therein, and in accordance only with the present invention, the auxiliary product dispenser assemblies 90 occupy the space between adjacent rows of product containers and more specifically, the space between the top portions of containers 24, which space in prior art dispensing assemblies normally goes to waste.

It is apparent from the above detailed description that the present invention accomplishes all of the objects set forth by providing a new and improved article dispensing apparatus which is capable of supporting a plurality of product containers in adjacent rows on a stacked array of shelves mountable on uprights in a compartment such as a refrigerated space. The invention further provides a first series of product containers preferably supported in rows in a side-by-side substantially parallel array on each shelf, and a second series of "auxiliary" product containers supported in dispenser trays preferably positioned in the normally unused space between adjacent rows of the first series of product containers, respectively. The shelves, in turn, are adjustably supported for fore and aft positioning on the uprights. The first series of products can be fed by gravity along inclined guide channels or by hand on a horizontally supported shelf to the front of each shelf whereas the second series of products can automatically be urged forwardly in their respective trays by a corresponding pusher or indexing assembly in each dispenser tray.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by Letters Patent of the United States is as follows:

1. An article dispensing apparatus comprising:

a first product dispenser assembly for supporting and dispensing a series of articles comprising a product of first quality, a second product dispenser assembly, said second dispenser assembly for supporting and dispensing a series of articles of a second quality, said first product support assembly occupying a defined first space, and said second dispenser assembly occupying a defined second space proximal to said defined first space, a supporting frame, said supporting frame defining a third space for housing both said first product dispenser assembly and said second product dispenser assembly, wherein said first product dispenser assembly is mounted on said supporting frame to define a first shelf, wherein said first shelf includes at least a first pair of substantially parallel guide rails for supporting and dispensing said series of articles comprising said product of first quality, wherein said first shelf further includes at least a second pair of substantially parallel guide rails for supporting and dispensing said articles comprising said product of first quality, said second pair of substantially parallel guide rails being spaced transversely on said first shelf with respect to said first pair of substantially parallel guide rails, and wherein said second product dispenser assembly is juxtaposed in a transverse space between said first pair of substantially parallel guide rails and said second pair of substantially parallel guide rails, said second product dispenser assembly being connected to one of said substantially parallel guide rails in said first pair of substantially parallel guide rails, such that said apparatus is adapted to dispense both said products of first quality and said products of said second quality from said third space defined by said supporting frame, and wherein said first space defined by said first product dispenser assembly and said second space defined by said second product dispenser assembly is confined within said third space defined by said supporting frame, wherein said second product dispenser assembly for supporting and dispensing a series of articles of second quality comprises a support for dispensing said row of said articles of second quality, said row comprising at least first and second articles in said row aligned serially and axially with respect to each other on said support, said support having a first end and a second end, said first end defining a display location for said first article in said row of articles, and means for automatically axially indexing said row of articles longitudinally on said support such that said second article in said row of articles is moved to and occupies said display location upon removal of said first article from said display location, wherein said means for automatically axially indexing said row of articles longitudinally on said support includes a pusher member on said support adapted to axially engage said second article in said row, and a first resilient member operatively coupled between said support and said pusher member for urging said pusher member toward said display location in an axial direction extending from said second end of said support toward said first end of said support, further including a second resilient member on said support proximal to said display location for engaging said first article in said row when it is positioned at said display location.

2. The apparatus of claim 1 wherein said first shelf is inclined on said supporting frame and said articles of first quality being dispensed by said first product dispenser assembly are being dispensed by gravity.

3. The apparatus of claim 1 further including a third resilient member on said support for engaging said second article in said row when said first article in said row is being engaged by said second resilient member.

4. The apparatus of claim 3 wherein said third resilient member is located axially a distance from said second resilient member between said display location and said second end of said support.

5. The apparatus of claim 3 wherein said second resilient member is a first cantilever leaf spring, said third resilient member is a second cantilever leaf spring, and said first and second cantilever leaf springs form separate portions of a common cantilever leaf spring assembly adapted to overlie said first end of said support.

6. The apparatus of claim 1 wherein said support comprises a longitudinally extending tray having a generally U-shaped cross-section, and said display location for first article in said row of articles defined by said first end of said support comprises an inclined ramp portion, said ramp portion terminating distally in a stop member for engaging said first article.

7. The apparatus of claim 1 further including a second shelf, said second shelf being mounted on said supporting frame underneath said first shelf wherein said first shelf and said second shelf are spaced relative to each other on said frame, and said second shelf further includes a merchandising panel mounted on said second shelf and being adapted to receive articles being dispensed from said first pair of substantially parallel guide rails on said first shelf.

8. The apparatus of claim 1 wherein said articles of first quality comprise beverage containers and said articles of second quality comprise candy bars.

9. An article dispensing apparatus comprising:

a first product dispenser assembly for supporting and dispensing a series of articles comprising a product of first quality, a second product dispenser assembly, said second dispenser assembly for supporting and dispensing a series of articles of a second quality, said first product support in a defined first space, and said second dispenser assembly occupying a defined second space proximal to said defined first space, a supporting frame, said supporting frame defining a third space for housing both said first product dispenser assembly and said second product dispenser assembly, wherein said first product dispenser assembly is mounted on said supporting frame to define a first shelf, wherein said first shelf includes at least a first pair of substantially parallel guide rails for supporting and dispensing said series of articles comprising said product of first quality, wherein said first shelf further includes at least a second pair of substantially parallel guide rails for supporting and dispensing said articles comprising said product of first quality, said second pair of substantially parallel guide rails being spaced transversely on said first shelf with respect to said first pair of substantially parallel guide rails, and wherein said second product dispenser assembly is juxtaposed in a transverse space between said first pair of substantially parallel guide rails and said second pair of substantially parallel guide rails, said second product dispenser assembly being connected to one of said substantially parallel guide rails in said first pair of substantially parallel guide rails, such that said apparatus is adapted to dispense both said products of first quality and said products of said second quality from said third space defined by said supporting frame, and wherein said first space defined by said first product dispenser assembly and said second space defined by said second product dispenser assembly is confined within said third space defined by said supporting frame, wherein said second product dispenser assembly for supporting and dispensing a series of articles of second quality comprises a support for dispensing said row of said articles of second quality, said row comprising at least first and second articles in said row aligned serially and axially with respect to each other on said support, said support having a first end and a second end, said first end defining a display location for said first article in said row of articles, and means for automatically axially indexing said row of articles longitudinally on said support such that said second article in said row of articles is moved to and occupies said display location upon removal of said first article from said display location, wherein said support comprises a longitudinally extending tray having a generally U-shaped cross-section to define a pair of opposed side walls extending longitudinally and axially of said support member, said opposed side walls having thereon outwardly extending, flexible, affixing members for removably attaching said support to a corresponding one of the rail members of the first and second pair of substantially parallel guide rails, said rail member having suitably sized and configured openings therein to securely removably receive said flexible affixing members.

10. An article dispensing apparatus comprising:

a first product dispenser assembly for supporting and dispensing a series of articles comprising a product of first quality, a second product dispenser assembly, said second dispenser assembly for supporting and dispensing a series of articles of a second quality, said first product support assembly occupying a defined first space, and said second dispenser assembly occupying a defined second space proximal to said defined first space, a supporting frame, said supporting frame defining a third space for housing both said first product dispenser assembly and said second product dispenser assembly, wherein said first product dispenser assembly is mounted on said supporting frame to define a first shelf, wherein said first shelf includes at least a first pair of substantially parallel guide rails for supporting and dispensing said series of articles comprising said product of first quality, wherein said first shelf further includes at least a second pair of substantially parallel guide rails for supporting and dispensing said articles comprising said product of first quality, said second pair of substantially parallel guide rails being spaced transversely on said first shelf with respect to said first pair of substantially parallel guide rails, and wherein said second product dispenser assembly is juxtaposed in a transverse space between said first pair of substantially parallel guide rails and said second pair of substantially parallel guide rails, said second product dispenser assembly being connected to one of said substantially parallel guide rails in said first pair of substantially parallel guide rails, such that said apparatus is adapted to dispense both said products of first quality and said products of said second quality from said third space defined by said supporting frame, and wherein said first space defined by said first product dispenser assembly and said second space defined by said second product dispenser assembly is confined within said third space defined by said supporting frame, wherein said second product dispenser assembly for supporting and dispensing a series of articles of second quality comprises a support for dispensing said row of said articles of second quality, said row comprising at least first and second articles in said row aligned serially and axially with respect to each other on said support, said support having a first end and a second end, said first end defining a display location for said first article in said row of articles, and means for automatically axially indexing said row of articles longitudinally on said support such that said second article in said row of articles is moved to and occupies said display location upon removal of said first article from said display location, wherein said support comprises a longitudinally extending tray including affixing members, said affixing members being adapted to removably attach said longitudinally extending tray to a second support, said second support being adapted to dispense articles of a different character than said series of articles of second quality.

11. The apparatus of claim 10 wherein said second support comprises means for supporting adjacent rows of said articles of said different character, and said longitudinally extending tray is adapted to be removably attached to said second support between at least a pair of said adjacent rows of said articles of said different character being supported by said second support.

12. An article dispensing apparatus comprising:

a first product dispenser assembly for supporting and dispensing a series of articles comprising a product of first quality, a second product dispenser assembly, said second dispenser assembly for supporting and dispensing a series of articles of a second quality, said first product support assembly occupying a defined first space, and said second dispenser assembly occupying a defined second space proximal to said defined first space, a supporting frame, said supporting frame defining a third space for housing both said first product dispenser assembly and said second product dispenser assembly, wherein said first product dispenser assembly is mounted on said supporting frame to define a first shelf, wherein said first shelf includes at least a first pair of substantially parallel guide rails for supporting and dispensing said series of articles comprising said product of first quality, wherein said first shelf further includes at least a second pair of substantially parallel guide rails for supporting and dispensing said articles comprising said product of first quality, said second pair of substantially parallel guide rails being spaced transversely on said first shelf with respect to said first pair of substantially parallel guide rails, and wherein said second product dispenser assembly is juxtaposed in a transverse space between said first pair of substantially parallel guide rails and said second pair of substantially parallel guide rails, said second product dispenser assembly being connected to one of said substantially parallel guide rails in said first pair of substantially parallel guide rails, such that said apparatus is adapted to dispense both said products of first quality and said products of said second quality from said third space defined by said supporting frame, and wherein said first space defined by said first product dispenser assembly and said second space defined by said second product dispenser assembly is confined within said third space defined by said supporting frame, wherein said second product dispenser assembly for supporting and dispensing a series of articles of second quality comprises a support for dispensing said row of said articles of second quality, said row comprising at least first and second articles in said row aligned serially and axially with respect to each other on said support, said support having a first end and a second end, said first end defining a display location for said first article in said row of articles, and means for automatically axially indexing said row of articles longitudinally on said support such that said second article in said row of articles is moved to and occupies said display location upon removal of said first article from said display location, wherein said support comprises a longitudinally extending tray having a generally U-shaped cross-section to define a pair of opposed side walls extending longitudinally and axially of said support member, said opposed side walls having thereon outwardly extending, affixing members for removably attaching said support to a corresponding one of the rail members of the first and second pair of substantially parallel guide rails, said rail member having suitably sized and configured openings therein to securely removably receive said affixing members.

* * * * *